US009581404B2

(12) United States Patent
Lyon

(10) Patent No.: US 9,581,404 B2
(45) Date of Patent: Feb. 28, 2017

(54) PROTECTIVE COVERING FOR A RIFLE

(71) Applicant: GUNSKINS, LLC., Grants Pass, OR (US)

(72) Inventor: Kevin G. Lyon, Grants Pass, OR (US)

(73) Assignee: GUNSKINS, LLC., Grants Pass, OR (US)

( * ) Notice: Subject to any disclaimer, the term of this patent is extended or adjusted under 35 U.S.C. 154(b) by 0 days.

(21) Appl. No.: 14/514,214

(22) Filed: Oct. 14, 2014

(65) Prior Publication Data

US 2015/0292831 A1 Oct. 15, 2015

Related U.S. Application Data

(60) Provisional application No. 61/891,070, filed on Oct. 15, 2013.

(51) Int. Cl.
*F41A 35/02* (2006.01)
*F41H 3/02* (2006.01)

(52) U.S. Cl.
CPC ..... *F41A 35/02* (2013.01); *F41H 3/02* (2013.01)

(58) Field of Classification Search
CPC ..... F41H 3/00; F41H 3/02; F41A 35/02
USPC ..... 42/96; 89/938; D22/108
See application file for complete search history.

(56) References Cited

U.S. PATENT DOCUMENTS 3,574,965 A * 4/1971 Seiger ..... F41A 35/02 42/96
RE32,752 E * 9/1988 Kiang ..... F41H 3/00 206/317
5,254,661 A * 10/1993 Wilson ..... E04D 5/12 428/141
5,615,505 A * 4/1997 Vaid ..... F41A 9/61 42/18
5,755,052 A * 5/1998 Keeney ..... F41A 9/65 42/50
5,778,590 A * 7/1998 Browning ..... B32B 27/08 42/96
5,848,491 A * 12/1998 Biemont ..... B23B 47/28 42/106
6,017,079 A * 1/2000 Warner ..... B60R 13/04 118/505

(Continued)

*Primary Examiner* — John D Cooper
(74) *Attorney, Agent, or Firm* — Allemen Hall McCoy Russell & Tuttle LLP

(57) ABSTRACT

A protective covering system includes a plurality of precut protective coverings configured from a waterproof material. Each of the precut protective coverings are configured to accommodate actuation of functional features and proper operation of the firearm. The protective covering system includes two precut protective coverings configured to substantially cover the upper receiver, two precut protective coverings configured to substantially cover the lower receiver, two precut protective coverings configured to substantially cover the pistol grip, two precut protective coverings configured to substantially cover the magazine well, two precut protective coverings configured to substantially cover the magazine, a precut protective covering configured to cover the ejection port cover, a precut protective covering configured to cover the forward assist, and a precut protective covering configured to cover the Picatinny rail such that the installation and removal of additional firearm accessories from the Picatinny rail is not impaired.

18 Claims, 2 Drawing Sheets

(56) References Cited

U.S. PATENT DOCUMENTS

| | | | | |
|---|---|---|---|---|
| D644,295 | S * | 8/2011 | Obradovich | D22/108 |
| 8,062,736 | B1 * | 11/2011 | Coolong | B29C 45/14811 264/129 |
| 8,104,215 | B2 * | 1/2012 | Lauer | F41H 3/02 42/96 |
| 8,307,577 | B2 * | 11/2012 | Baxter | F41A 35/02 206/317 |
| 8,327,572 | B2 * | 12/2012 | Boggan | F41A 35/02 42/96 |
| 2004/0118503 | A1 * | 6/2004 | Record | F41H 3/00 156/85 |
| 2006/0112606 | A1 * | 6/2006 | Lauer | F41H 3/02 42/96 |
| 2011/0023347 | A1 * | 2/2011 | Boggan | F41A 35/02 42/96 |
| 2011/0151191 | A1 * | 6/2011 | Cincotti | F41H 3/02 428/143 |
| 2012/0186737 | A1 * | 7/2012 | Burdine | F41H 3/00 156/249 |

* cited by examiner

PROTECTIVE COVERING FOR A RIFLE

CROSS REFERENCE TO RELATED APPLICATIONS

The present application claims priority to U.S. Provisional Patent Application No. 61/891,070, entitled "PROTECTIVE COVERING FOR A RIFLE," filed on Oct. 15, 2013, the entire contents of which are hereby incorporated by reference for all purposes.

BACKGROUND

Firearms are subject to wear damage from normal use. Additionally, the metal surfaces of the firearm may undergo corrosion from exposure to the elements and skin oils. Combatting normal wear and tear and corrosion requires significant time investment and financial cost to maintain the firearm in proper working order.

SUMMARY

A protective covering system for a firearm is disclosed. The protective covering system includes a plurality of precut protective coverings configured from a waterproof material. Once applied to the firearm, each of the precut protective coverings are further configured to accommodate actuation of functional features and proper functioning of the firearm. The protective covering system includes two precut protective coverings configured to substantially cover the upper receiver, two precut protective coverings configured to substantially cover the lower receiver, two precut protective coverings configured to substantially cover the pistol grip, two precut protective coverings configured to substantially cover the magazine well, two precut protective coverings configured to substantially cover the magazine, a precut protective covering configured to cover the ejection port cover, a precut protective covering configured to cover the forward assist, and a precut protective covering configured to cover the Picatinny rail. The precut protective covering for the Picatinny rail includes a plurality of rectangular cutouts so as not to impair the installation and removal of additional firearm accessories from the Picatinny rail.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
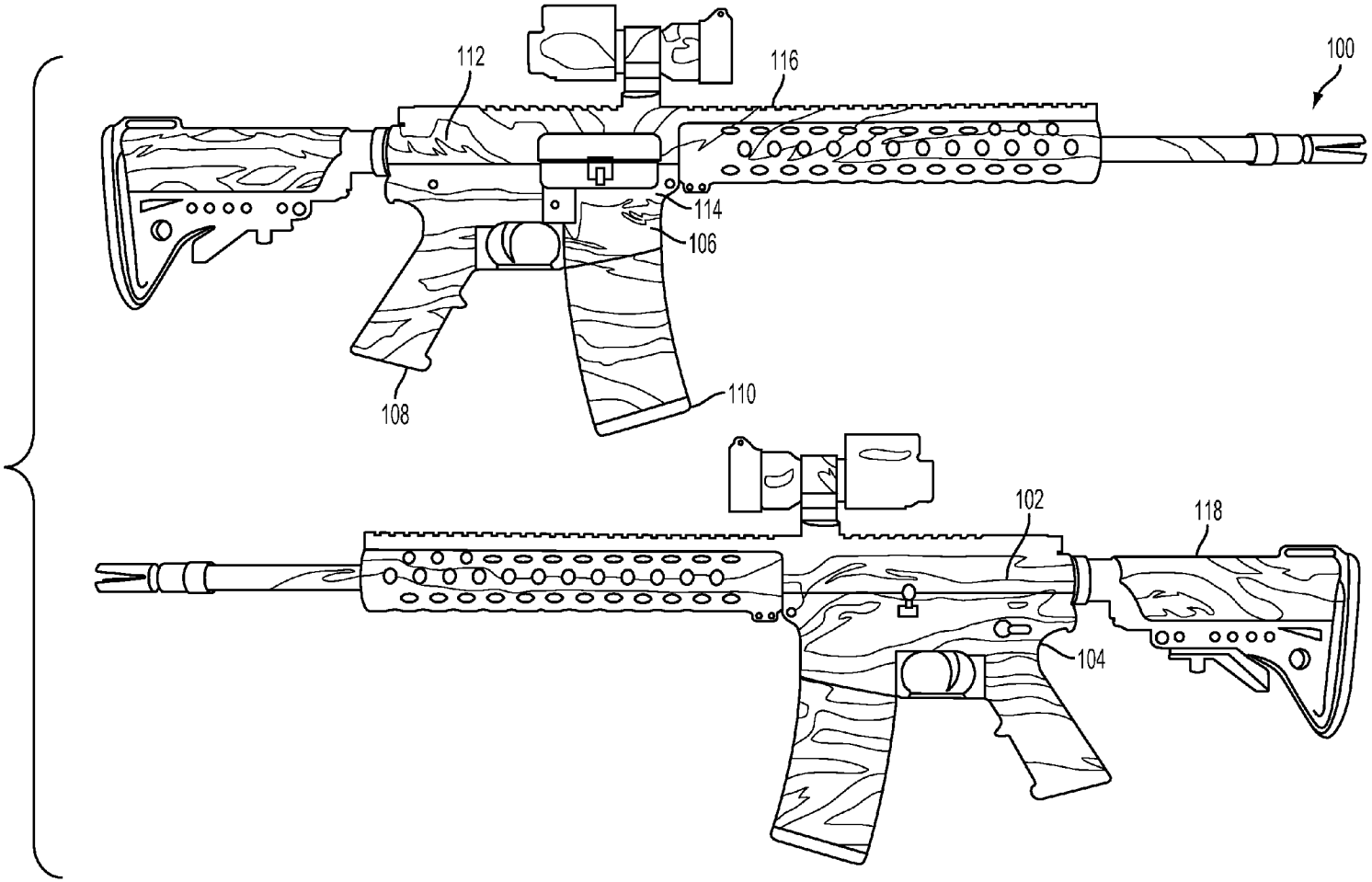
FIG. 1 is a right side and a left side perspective view of a protective covering system applied to an example firearm.

Described herein generally is a protective covering system for a firearm. The protective covering system may include a plurality of precut coverings configured to cover a respective component of the firearm that, once applied and fixed, form a protective barrier to the elements and other damaging factors. FIG. 1 illustrates a protective covering system 100 applied to an example firearm. In this non-limiting example, the firearm is configured with an upper receiver, a lower receiver, a pistol grip, a magazine well, an ejection port, an ejection port cover, a forward assist, a Picatinny rail system, and a magazine. It will be appreciated that the example firearm may include functional features including a safety selector switch, magazine release, a butt stock, and any other suitable functional features required for safe and proper operation of the firearm. Further, engineering and design factors may require these functional features be placed asymmetrically on the firearm. For example, the ejection port may be placed on the right side of a firearm configured to be shot right-handedly to eject the spent shell casing away from the operator. In order to not impair the proper functioning of the firearm and/or impair access to the functional features, protective covering system 100 may include a plurality of precut protective coverings configured from a waterproof or water resistant material such as a nylon polymer, vinyl polymer, or other suitable water resistant polymer, for example. Furthermore, the waterproof material may be a printable material configured with a printed design. The printed design may be any of a plurality of camouflage patterns or any other suitable pattern.

Each of the plurality of precut cut protective coverings of protective covering system 100 may be cut to a specific shape in order to cover a specific part of the firearm. Furthermore, when applied each of the plurality of precut coverings may be configured to accommodate actuation of the functional features and the proper functioning of the firearm.

As illustrated in FIG. 1, protective covering system 100 includes two precut protective coverings configured to substantially cover the upper receiver 102, two precut protective coverings configured to substantially cover the lower receiver 104, two precut protective coverings configured to substantially cover the pistol grip 108, two precut protective coverings configured to substantially cover the magazine well 106, two precut protective coverings configured to substantially cover the magazine 110, a precut protective covering configured to cover the ejection port cover 114, a precut protective covering configured to cover the forward assist 112, and a precut protective covering configured to cover the Picatinny rail 116. Specifically, FIG. 1 illustrates protective covering system 100 configured for an AR-15 rifle.

It will be appreciated that protective covering system 100 for the AR-15 rifle of FIG. 1 may also be applied to the military M-4 rifle and M-16 rifle platforms which share the same weapons platform design as the AR-15 rifle. It will also be appreciated that the protective covering system 100 for the AR-15 is exemplary in nature and that additional protective covering system designs fitting other rifles and firearms are considered within this disclosure.

Figure 2:
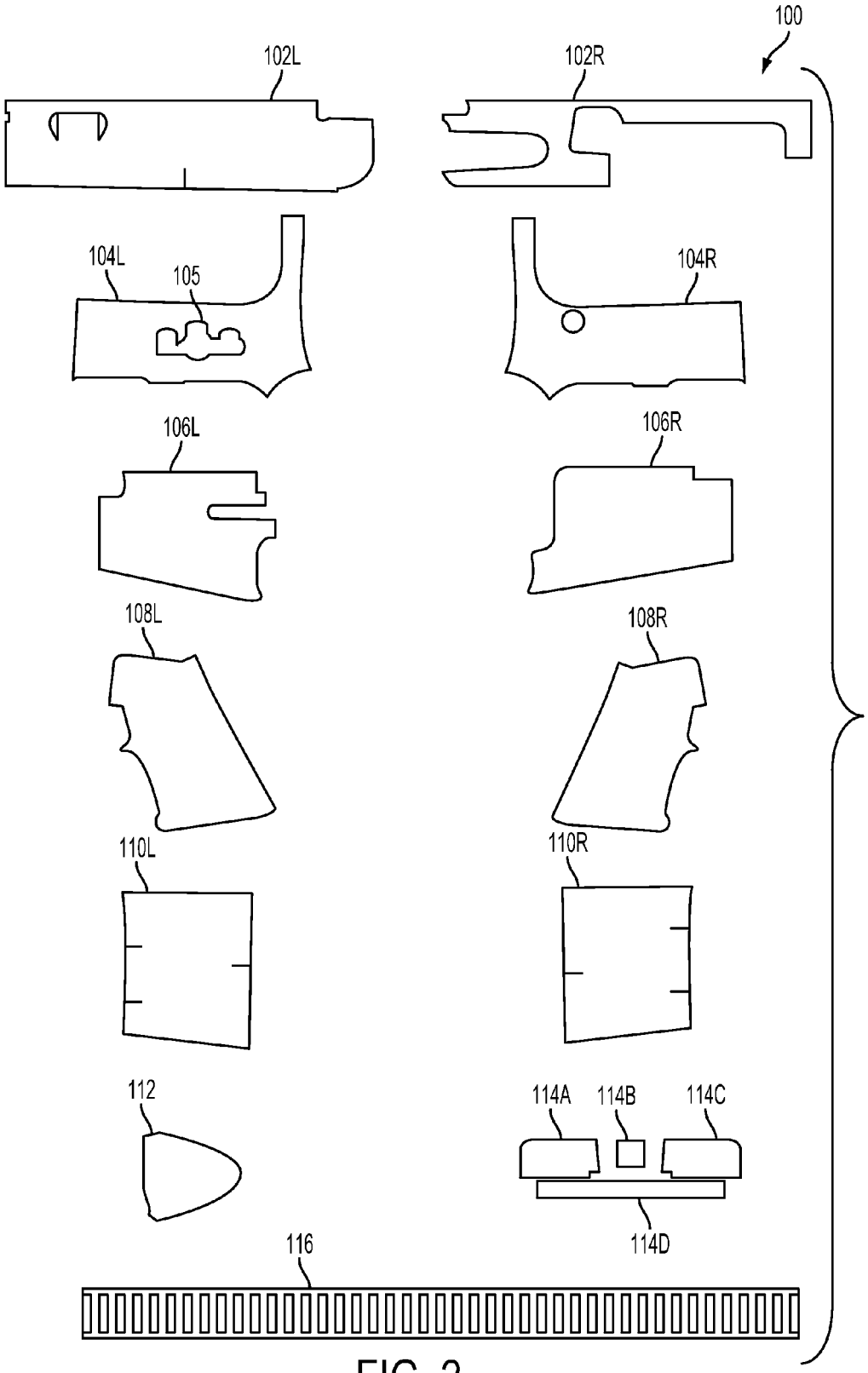
FIG. 2 illustrates a component view of the protective covering system of FIG. 1.

As shown if FIG. 2, the precut protective covering for the Picatinny rail 116 includes a plurality of rectangular cutouts. These cutouts are configured such that installation and removal of additional firearm accessories to and from the Picatinny rail is not impaired. Specifically, the precut protective covering for the Picatinny rail 116 may be substantially a rectangle 16.0" long by 1.125" in width and covering an upper surface of the Picatinny rail. The plurality of rectangular cutouts may begin at a rear edge of precut protective covering for the Picatinny rail 116 substantially centered between the upper and lower edge. The plurality of rectangular cutouts may be spaced 0.375" apart center-on-center toward the forward edge the precut protective covering. In alternative embodiments the plurality of rectangular cutouts may not be provided allowing a user to selectively cut the protective covering to form a customized protective covering for a Picatinny rail or other suitable rail-type firearm accessory attachment system.

Turning back to FIG. 1, protective covering system 100 may include a protective covering configured to substantially cover a butt stock 118 of the firearm. It will be appreciated that additional water resistant material may be included in protective covering system 100 to allow for covering other features of the firearm such as additional hand guards/grips, the barrel, optics, or any other firearm accessory. In other embodiments protective covering system 100 may include a substantially rectangular sheet of protective covering allowing a user to selectively cut a protective covering to fit a specific feature of the firearm and/or firearm accessory. In another embodiment, the additional protective covering may include precut circular holes that may be matched to the barrel ventilation holes in a forward hand guard of the AR-15 rifle.

As discussed above, the firearm may have functional features present on either a left side or a right side of the firearm such as a safety selector switch, a magazine release switch, and a charging handle, for example. To accommodate these functional features, the precut protective coverings may be cut to different configurations. FIG. 2 illustrates a component view of each precut protective covering. For example, the two precut protective coverings covering the upper receiver are configured such that a left side covering of the upper receiver 102L may be configured to accommodate the functional features present on the left side of the upper receiver of the firearm, and a right side covering of the upper receiver 102R may be configured to accommodate the functional features present on the right side of the upper receiver of the firearm. In this example, the right side covering of the upper receiver 102R may be configured to accommodate an ejection port and a shell casing deflector which accounts for the difference in shape between the left side and right side coverings for the upper receiver.

Turning specifically to left side covering of the upper receiver 102L, left side covering of the upper receiver 102L may be specifically sized to accommodate an AR-15 rifle. In the illustrated example, precut 102L may have a substantially rectangular shape. A relief cut-out on left side covering of the upper receiver 102L may be formed on the rear edge extending forward along the top edge of the rectangular shape. This relief cut-out may substantially correspond to and allow actuation of the charging handle of the AR-15. In some examples, left side cover of the upper receiver 102L may have dimensions such as 7.117"×1.765". It should be appreciated that the relief cut-out may be precut such that a user can automatically align the cutout with the left upper receiver of the AR-15. In other embodiments, a user may selectively cut the precut to form a customized relief cut-out.

Upon installation on an AR-15, left side covering of the upper receiver 102L may be aligned to abut a front edge of the upper receiver and extend rearward to the charging handle. Left side covering of the upper receiver 102L may be configured to substantially cover the left side of the upper receiver from the top edge and downward such that a front half of the bottom edge of left side covering of the upper receiver 102L abuts a top edge of left side covering of the magazine well 106L and a rear half of the bottom edge abuts a top edge of left side covering of the lower receiver 104L. Furthermore, the rear edge of left side covering of the upper receiver 102L abuts with a front edge of an upward projection of left side covering of the lower receiver 104L.

Now turning specifically to right side covering of the upper receiver 102R, right side covering of the upper receiver 102R may be specifically sized to accommodate an AR-15 rifle. In the illustrated example, right side covering of the upper receiver 102R may have a substantially rectangular shape and may include a plurality of relief cutouts. In some examples, the right side covering of the upper receiver 102R may have dimensions such as 7.021"×1.692" A first half ellipse shaped relief cut-out on right side covering of the upper receiver 102R may be formed on the rear edge extending to forward 2" toward the mid-section of the rectangular shape. This relief cut-out may substantially correspond to the forward assist of the AR-15. Right side cover of the upper receiver 102R may be further configured with a second relief cutout to accommodate the ejection port and the spent casing deflector of the AR-15. The second relief cutout may begin at a front lower corner of right side covering of the upper receiver 102R extending 0.5625" toward an upper edge and rearward 0.5" to a second upward cut extending 0.625" toward the upper edge. The second relief cutout then proceeds rearward 3.375" toward a third cut extending 0.625" toward the upper edge and 0.75" rearward. The rear edge of the second relief cutout proceeds downward 0.78125" measured vertically and rearward 0.1875" measured horizontally. The second relief cutout then proceeds forward 0.71825" before proceeding downward to the bottom edge of right side cover of the upper receiver 102R. It will be appreciated that the corners of the second relief cut may be substantially rounded in some embodiments and substantially angular in others. It should be appreciated that the relief cut-out may be precut such that a user can automatically align the cutout with the right upper receiver of the AR-15. In other embodiments, a user may selectively cut the precut to form a customized relief cut-out.

Upon installation on an AR-15, right side covering of the upper receiver 102R may be aligned to abut a front edge of the upper receiver and extend rearward to the charging handle. Right side covering of the upper receiver 102R may be configured to substantially cover the Right side of the upper receiver from the top edge and downward and around the ejection port and a rearward most 3.25" of the bottom edge abuts a top edge of right side covering of the lower receiver 104R. Furthermore, the rear edge of right side covering of the upper receiver 102R abuts with a front edge of an upward projection of right side covering of the lower receiver 104R. Additionally a front portion of the precut covering for the forward assist 112.

Together, left side covering of the upper receiver 102L and right side covering of the upper receiver 102R cover the lateral and exposed sides of the upper receiver.

As a second example, the two precut protective coverings covering the lower receiver may be configured such that a left side covering of the lower receiver 104L is configured to accommodate the functional features present on the left side of the lower receiver of the firearm and a right side covering of the lower receiver 104R is configured to accommodate the functional features present on the right side of the lower receiver of the firearm. Left side covering of the lower receiver 104L may be configured with a relief cutout 105 corresponding to and accommodating actuation of safety selector switch of the firearm.

Turning specifically to both the left side covering of the lower receiver 104L and right side covering of the lower receiver, both lower receiver coverings may be substantially symmetrical in shape when be specifically sized to accommodate an AR-15 rifle. In the illustrated example, both lower receiver coverings 104L and 104R may have a substantially "L" shape. In some examples, the both left side and right side coverings of the lower receiver may have dimensions such as 4.2"×3.2" in width along the rear edge and 1.375" in width along the forward edge. Beginning from the rear edge the top edge proceeds forward for 0.375" before moving downward 1.625" to accommodate the upper receiver of the AR-15. The uppermost edge then proceeds forward to the front edge of covering of the lower receiver. A relief cut-out on right side covering of the lower receiver 104R may be centered 1" from the rear edge and 1.125" from the bottom edge to correspond to the takedown pin of the AR-15. A circular cut-out on right side covering of the lower receiver 104R may be centered 1.875" from the rear edge and 0.625" from the bottom edge to accommodate the safety selector switch of the AR-15. It should be appreciated that the relief cut-outs may be precut such that a user can automatically align each of the left side and right side coverings of the lower receiver with the corresponding side of the lower receiver of the AR-15. In other embodiments, a user may selectively cut the precut to form a customized relief cut-out.

Upon installation on an AR-15, the left side covering of the lower receiver 104L may be aligned to abut a front edge of the lower receiver and extend rearward to the rear edge of the lower receiver. Left side covering of the lower receiver 104L may be configured to substantially cover the left side of the lower receiver from the top edge and abutting the bottom edge of the left side cover of the upper receiver 102L and downward such that a front edge of left side covering of the lower receiver 104L abuts a rear edge of left side covering of the magazine well 106L and a rear half of the bottom edge abuts a top edge of left side covering of the pistol grip 108L. Furthermore, the bottom edge of left side covering of the lower receiver 104L abuts the bottom edge of the lower receiver of the AR-15.

As a third example, a left side covering of the magazine well 106L may be configured to accommodate actuation of a magazine release switch accounting for the difference in shape from a right side covering of the magazine well 106R.

Both the left side covering of the magazine well 106L and the right side covering of the magazine well 106R may be configured to fit the magazine well of the AR-15 rifle. Both the left side covering and the right side covering of the magazine well are substantially rectangular with a dimension of 3.496"×2.17". Left side covering of the magazine well 106L may be configured with a half ellipse shaped relief cutout centered 0.75" from the top edge corresponding to and allowing the actuation of a magazine release switch of the AR-15.

When installed on the AR-15, the front edge of both the left side and right side covering of the magazine well abuts the front edge of the magazine well of the AR-15. The top edge of left side covering of the magazine well 106L abuts with the bottom edge of left side covering of the upper receiver 102L. The top edge of the right side covering of the magazine well 106R abuts with a bottom edge of the ejection port of the AR-15. It will be appreciated that the shape and location of the respective left and right side covering of the magazine well may allow the covering to be automatically aligned with the magazine well of the AR-15. In other embodiments, a user may selectively cut the precut to form a customized relief cut-out.

In other areas of the firearm, the left side and right side coverings of a respective feature of the firearm arm are symmetrical. For example, the left side covering of the pistol grip 108L, right side covering of the pistol grip 108R, and the left side covering of the magazine 110L, and the right side covering of the magazine 110R.

The left side covering of the pistol grip 108L and the right side covering of the pistol grip 108R may be configured to fit the pistol grip of the AR-15 rifle with a dimension of 3.575"×4.193". When installed on the AR-15, the top edge of the covering for the pistol grip abuts with a bottom edge of the covering for the lower receiver. Both left side and right side coverings of the pistol grip substantially cover the pistol grip.

With regard to the left side covering of the magazine 110L and the right side covering of the magazine 110R, both coverings of the magazine may be configured with a substantially rectangular shape with the dimensions of 3.677"×4.478". It will be appreciated that when installed, both coverings of the magazine well will substantially cover the magazine for an AR-15 and not impair the installation or removal of the magazine from the AR-15.

Additionally, protective covering system 100 may include precut protective coverings for functional features of the firearm such as the precut protective covering for the forward assist 112, the precut protective covering for the ejection port dust cover 114A, 114B, 114C, and 114D, and the precut covering for the Picatinny rail 116. It will be appreciated that in some configurations the precut protective covering ejection port dust cover may include multiple precut protective coverings, for example the four precut protective coverings 114A, 114B, 114C, and 114D of FIG. 2.

Turning specifically to the precut protective covering for the forward assist 112, the precut protective covering for the forward assist may be configured to fit the forward assist of the AR-15. The precut covering of the forward assist may be configured with a half ellipse shape with a dimension of 2.173"×1.959" and configured to substantially cover the forward assist such that precut protective covering of the forward assist 112 abuts the right side covering of the upper receiver 102R along the front, upper, and lower edges.

Turning now to the precut protective covering for the ejection port dust cover, the precut coverings for the ejection port cover 114A and 114C may be substantially rectangular with a dimension of 1.15625"×0.625". Precut covering for the ejection port dust cover 114B may be substantially square with a dimension of 0.4375"×0.4375". Precut covering for the ejection port cover 114D may be substantially rectangular with a dimension of 3.575"×0.25".

The configuration of protective covering system 100 has been thus far discussed and illustrated in respect to the specific configuration of the AR-15 firearm shown in FIG. 1. It will be understood that the dimensions described above may include a tolerance of +/−10%. It should be further understood that protective covering system 100 may include other embodiments configured to cover pistols, other rifle designs, shotguns, or any other suitable firearm design.

Each of the plurality of precut coverings of protective covering system 100 may include a temporary adhesive on a back side to fix each precut covering in place during attachment of protective covering system 100. Additionally, the plurality of precut protective coverings may be fixed in place using a heat source such as a hot air gun, for example. It will also be appreciated that in addition to the plurality of precut protective being configured to be heat fixable, the plurality of precut protective coverings may be further configured to be removable. For example, a second heat application may reverse the adhesion and allow each of the plurality of precut protective coverings to be removed from the firearm.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A protective covering system for a firearm having an upper receiver, a lower receiver, a pistol grip, a magazine well, an ejection port, an ejection port cover, a forward assist, a Picatinny rail system, and a magazine, the protective covering system comprising:

a plurality of precut protective coverings configured from a waterproof material, wherein each of the precut protective coverings match the shape of and are further configured to, when applied, accommodate actuation of functional features and proper functioning of the firearm;

the plurality of precut protective coverings comprising:

two precut protective coverings matching the shape of and configured to substantially cover the upper receiver;

two substantially L shaped precut protective coverings matching the shape of and configured to substantially cover the lower receiver, wherein each precut protective covering configured to substantially cover the lower receiver includes one or more precut relief cutouts disposed within an internal region of the precut protective covering, wherein a shape of the internal region aligns with a safety selector switch;

two precut protective coverings matching the shape of and configured to substantially cover the pistol grip;

two precut protective coverings matching the shape of and configured to substantially cover the magazine well;

two precut protective coverings matching the shape of and configured to substantially cover the magazine;

a precut protective covering matching the shape of and configured to cover the ejection port cover;

a substantially half ellipse shaped precut protective covering matching the shape of and configured to cover the forward assist; and a precut protective covering matching the shape of and configured to cover the Picatinny rail including a plurality of rectangular cutouts disposed within an internal region of the precut protective covering configured such that installation and removal of additional firearm accessories from the Picatinny rail is not impaired.

2. The protective covering system of claim 1, wherein the two precut protective coverings covering the upper receiver are configured such that:

a left side covering of the upper receiver is configured to accommodate the functional features present on the left side of the upper receiver of the firearm; and a right side covering of the upper receiver is configured to accommodate the functional features present on the right side of the upper receiver of the firearm.

3. The protective covering system of claim 2, wherein the right side covering of the upper receiver is configured to accommodate the ejection port and a shell casing deflector.

4. The protective covering system of claim 1, wherein the two precut protective coverings covering the lower receiver are configured such that:

a left side covering of the lower receiver is configured to accommodate the functional features present on the left side of the lower receiver of the firearm; and a right side covering of the lower receiver is configured to accommodate the functional features present on the right side of the lower receiver of the firearm.

5. The protective covering system of claim 4, wherein the left side covering of the lower receiver is configured to accommodate actuation of the safety selector switch of the firearm.

6. The protective covering system of claim 1, further comprising a protective covering configured to cover a butt stock of the firearm.

7. The protective covering system of claim 1, wherein a left side covering of the magazine well is configured to accommodate actuation of a magazine release switch.

8. The protective covering system of claim 1, wherein the waterproof material is a printed vinyl material.

9. The protective covering system of claim 1, wherein the plurality of precut protective coverings are heat fixable.

10. The protective covering system of claim 1, wherein the plurality of protective coverings are removable.

11. The protective covering system of claim 1, wherein the two precut protective coverings configured to substantially cover the upper receiver and the precut protective covering configured to substantially cover the Picatinny rail each comprise one or more precut relief cutouts disposed within an internal region of each precut protective covering.

12. A protective covering system for a firearm having an upper receiver, a lower receiver, a pistol grip, a magazine well, an ejection port, an ejection port cover, a forward assist, a Picatinny rail system, and a magazine, the protective covering system comprising:

a plurality of precut protective coverings configured from a waterproof material, wherein each of the precut protective coverings are further configured to, when applied, accommodate actuation of functional features and proper functioning of the firearm;

the plurality of precut protective coverings comprising:

a precut protective covering matching the shape of and configured to cover a respective left side of the upper receiver;

a precut protective covering matching the shape of and configured to cover a respective right side of the upper receiver accommodating the ejection port cover and a shell casing deflector;

a substantially L shaped precut protective covering matching the shape of and configured to cover a respective left side of the lower receiver accommodating actuation of a safety selector switch of the firearm;

wherein the protective covering configured to cover the respective left side of the lower receiver includes one or more precut relief cutouts disposed within an internal region of the protective covering, wherein a shape of the internal region aligns with the safety selector switch;

a substantially L shaped precut protective covering matching the shape of and configured to cover a respective right side of the lower receiver;

two precut protective coverings matching the shape of and configured to cover a respective left side and a respective right side of the pistol grip;

a precut protective covering matching the shape of and configured to cover a respective left side of the magazine well accommodating actuation of a magazine release switch;

a precut protective covering matching the shape of and configured to cover a respective right side of the magazine well;

two precut protective coverings matching the shape of and configured to cover a respective left side and a respective right side of the magazine;

four precut protective coverings matching the shape of and configured to cover the ejection port cover;

a precut protective covering matching the shape of and configured to cover the forward assist; and a precut protective covering matching the shape of and configured to cover the Picatinny rail including a plurality of rectangular cutouts disposed within an internal region of the precut protective covering configured such that installation and removal of additional firearm accessories from the Picatinny rail is not impaired.

13. The protective covering system of claim 12, further comprising a precut protective covering configured to cover a butt stock of the firearm.

14. The protective covering system of claim 12, wherein the waterproof material is a printable vinyl material.

15. The protective covering system of claim 12, wherein the plurality of protective coverings are heat fixable.

16. The protective covering system of claim 12, wherein the plurality of protective coverings are removable.

17. The protective covering system of claim 12, wherein the precut protective covering configured to cover the respective right side of the lower receiver and the precut protective covering configured to cover the respective left side of the upper receiver each comprise one or more precut relief cutouts disposed within an internal region of each precut protective covering.

18. A protective covering system for a firearm having an upper receiver, a lower receiver, a pistol grip, a magazine well, an ejection port, an ejection port cover, a forward assist, and a magazine, the protective covering system comprising:

a plurality of precut protective coverings, wherein each of the plurality of protective coverings match the shape of and are configured to substantially cover the upper receiver, the lower receiver, the pistol grip, the magazine well, the ejection port, the ejection port cover, the forward assist, and the magazine;

the plurality of precut protective coverings comprising:

two precut protective coverings matching the shape of and configured to substantially cover the upper receiver;

two substantially L shaped precut protective coverings matching the shape of and configured to substantially cover the lower receiver, wherein each precut protective covering configured to substantially cover the lower receiver includes one or more precut relief cutouts disposed within an internal region of the precut protective covering, wherein a shape of the internal region aligns with a safety selector switch;

two precut protective coverings matching the shape of and configured to substantially cover the pistol grip;

two precut protective coverings matching the shape of and configured to substantially cover the magazine well;

two precut protective coverings matching the shape of and configured to substantially cover the magazine;

a precut protective covering matching the shape of and configured to substantially cover the ejection port cover; and a substantially half ellipse shaped precut protective covering matching the shape of and configured to cover the forward assist.

* * * * *